US011506033B2

(12) United States Patent
Tang et al.

(10) Patent No.: US 11,506,033 B2
(45) Date of Patent: Nov. 22, 2022

(54) OIL EXTRACTION AND GAS PRODUCTION METHOD CAPABLE OF IN-SITU SAND CONTROL AND REMOVAL BY DOWNHOLE HYDRAULIC LIFT

(71) Applicant: Southwest Petroleum University, Chengdu (CN)

(72) Inventors: Yang Tang, Chengdu (CN); Haoyu Xiong, Chengdu (CN); Guorong Wang, Chengdu (CN); Jinzhong Wang, Chengdu (CN); Jinhai Zhao, Chengdu (CN); Guangjie Yuan, Chengdu (CN); Zhidong Zhang, Chengdu (CN); Xushen Li, Chengdu (CN); Yufa He, Chengdu (CN); Jie Wu, Chengdu (CN); Xin Jing, Chengdu (CN); Peng Zhao, Chengdu (CN); Zeliang Li, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 17/566,556

(22) Filed: Dec. 30, 2021

(65) Prior Publication Data

US 2022/0205347 A1 Jun. 30, 2022

(30) Foreign Application Priority Data

Dec. 31, 2020 (CN) ..... 202011637217.5

(51) Int. Cl.
*E21B 43/12* (2006.01)
*E21B 43/04* (2006.01)
*E21B 43/38* (2006.01)

(52) U.S. Cl.
CPC ..... *E21B 43/124* (2013.01); *E21B 43/04* (2013.01); *E21B 43/385* (2013.01)

(58) Field of Classification Search
CPC ..... E21B 43/124; E21B 43/385; E21B 43/04; E21B 43/13; E21B 43/121
See application file for complete search history.

(56) References Cited

U.S. PATENT DOCUMENTS 3,105,443 A * 10/1963 Johnson ..... F04B 47/02 318/482
3,247,798 A * 4/1966 Glasgow ..... E21B 43/12 417/43

(Continued)

FOREIGN PATENT DOCUMENTS

CA 2880906 A1 2/2014
CN 105201438 A 12/2015

(Continued)

OTHER PUBLICATIONS

Wang GuoGrong et al., "Researchon Marine Petroleumand Hydrate Development Technology Basedon Dual Gradient Drillingof DoubleGLayer Pipe", Ocean Engineering Equipment and Technology vol. 06, Issue S1, Nov. 30, 2019, pp. 225-233.

(Continued)

*Primary Examiner* — Shane Bomar

(57) ABSTRACT

Disclosed is an oil extraction and gas production method capable of in-situ sand control and removal by downhole hydraulic lift achieved by downhole oil extraction and gas production system and ground oil extraction and gas production system. The downhole systems mainly comprises a double-layer tube, a double-layer tube reducing joint, a double-layer tube packer, a hydrodynamic turbine motor, a sludge screw pump, a soil-sand separator and a negative pressure absorber; the ground system comprises a power fluid pressurizing module and a mix fluid treatment module. The present application lowers the difficulty of pumping and lifting downhole formation fluid; achieves downhole and in-situ sand control and sand discharge, alleviates the block- (Continued)

age and erosion of sand particles on equipments and reduces energy consumption; decreases the production cost and improves the operation efficiency, therefore is suitable for oil extraction and gas production in high sand content wells.

5 Claims, 8 Drawing Sheets

(56) References Cited

U.S. PATENT DOCUMENTS

| | | | | |
|---|---|---|---|---|
| 5,006,044 | A * | 4/1991 | Walker, Sr. | E21B 47/009 417/43 |
| 5,063,775 | A * | 11/1991 | Walker, Sr. | E21B 47/009 73/152.52 |
| 5,222,867 | A * | 6/1993 | Walker, Sr. | E21B 47/009 417/63 |
| 5,941,305 | A * | 8/1999 | Thrasher | E21B 47/008 417/18 |
| 6,189,613 | B1 | 2/2001 | Chachula et al. | |
| 6,336,503 | B1 * | 1/2002 | Alhanati | E21B 43/385 166/313 |
| 8,302,694 | B2 * | 11/2012 | Zupanick | E21B 43/126 166/369 |
| 10,428,627 | B2 * | 10/2019 | Elmer | G05B 19/042 |
| 10,428,635 | B2 * | 10/2019 | Ayub | E21B 43/02 |
| 10,557,337 | B2 * | 2/2020 | Ayub | E21B 43/128 |
| 2017/0096884 | A1 | 4/2017 | Michel | |
| 2020/0040710 | A1 | 2/2020 | Tang et al. | |
| 2021/0079762 | A1 * | 3/2021 | Wang | B02C 23/10 |
| 2022/0243564 | A1 * | 8/2022 | Tang | E21B 43/40 |

FOREIGN PATENT DOCUMENTS

| | | | |
|---|---|---|---|
| CN | 105960507 | A | 9/2016 |
| CN | 107816337 | A | 3/2018 |
| CN | 108049845 | A | 5/2018 |
| CN | 108119100 | A | 6/2018 |
| CN | 108643869 | A | 10/2018 |
| WO | 20190071114 | A1 | 4/2019 |
| WO | 2019223266 | A1 | 11/2019 |

OTHER PUBLICATIONS

Tina Boyuan et al., "Anti-pollution and continuous sand flushing technique", Special Oil & Gas Reservoirs, vol. 08, Issue 02, Jun. 30, 2001, pp. 63-66.

Zhang Jin]shan et al.,"Present situation and prospect of downhole oil-water separation technology", Chemical Engineer, vol. 34, Issue 07, Jul. 31, 2020, pp. 69-72.

Shunzuo Qiu et al., "The downhole hydrocyclone separator for purifying natural gas hydrate: structure design, optimization, and performance", Separation Science and Technology, vol. 55, Issue 03, Feb. 11, pp. 564-574.

* cited by examiner

OIL EXTRACTION AND GAS PRODUCTION METHOD CAPABLE OF IN-SITU SAND CONTROL AND REMOVAL BY DOWNHOLE HYDRAULIC LIFT

CROSS-REFERENCE TO RELATED APPLICATIONS

This application claims priority to Chinese Application No. 202011637217.5, filed on Dec. 31, 2020, entitled "an oil extraction and gas production method capable of in-situ sand control and removal by downhole hydraulic lift". These contents are hereby incorporated by reference.

TECHNICAL FIELD

The present invention relates to the technical area of petroleum and natural gas exploitation, more specifically an oil extraction and gas production method capable of in-situ sand control and removal by downhole hydraulic lift.

BACKGROUND

Petroleum and natural gas are of very important role in national economic development. Our country has widely distributed loose sandstone oil and gas storage and has been a major source for most petroleum companies at present. However, as the phenomenon sand production intensively occurs in the exploitation of the loose sandstone oil and gas storage, the normal production of petroleum in our country is greatly compromised. Natural gas hydrate (also known as "flammable ice") as an extremely clean and replaceable energy of high density and higher calorific value, will become one of major directions for future replaceable energy development in our country. Marine natural gas hydrate resource is extremely rich and deep water subbottom non-hematological natural gas accounts up to 85%. However, in recent years, the problem of massive sand production has always occurred globally during the intensive trial exploitations of deepwater gas hydrates. The prior art cannot effectively achieve sand discharge and sand control, directly affecting the production and even stopping the trial exploitation operations. Although a plurality of processes have been used with regard to the problem that massive sand production occurs during the exploitation of petroleum and natural gas as well as deep water seabed flammable ice, many problems still remain:

(1) The utilization of traditional single mechanical or chemical sand control exploitation methods requires an a specialized filling tool to fill large amount of filtration materials such as gravels in an oil mouth of the bottom hole. Although this method can prevent sand particles from entering into the wellbore, it will increase resistance that hinders the formation fluid to flow into the wellbore, resulting in the phenomenon of low oil well production efficiency and reduced production. At the same time, since the diameter of soil-sands in hydrate rock formation reaches the micron size, the traditional single sand control device and technology cannot meet the requirements during the flammable ice exploitation process.

(2) The utilization of a single oil-well pump for suction lift shows poor efficiency when it comes to high sand content oil, high-viscosity oil and high sand flammable ice. When sand content in the formation fluid is high, the pump block phenomenon is extremely inclined to occur, which will disable the oil pump to work normally, shorten the pump check period and directly affect the oil extraction and gas production efficiency.

(3) If formation fluid of high sand content enters the wellbore without a treatment in time, sands will be deposited and block the wellbore and even entirely prevent formation fluid from entering the wellbore, which will cause the viscosity and density of mixed fluid to increase during pipeline transportation. At the same time, formation fluid of high sand content will loosen the reservoir and form unstable back boreholes in the goaf, which will result in the hydrate reservoir collapse and further cause disasters such as tsunami and earthquake during the seabed fie ice exploitation.

(4) During the process of lifting the formation fluid of high sand content to the ground, the carried sand particles will severely erode and block downhole tools, wellbores in pipeline transportation section and pump transportation equipments, greatly shorten the service life thereof, resulting in a high failure rate and increased exploitation costs.

In summary, the traditional single sand control technology, routine oil pump lift and the existing oil extraction and gas production technique have failed to solve problems occurred during exploitation process of loose sandstone reservoir and seabed unstratified rock flammable ice, making it is urgent to invent a novel oil extraction and gas production method.

SUMMARY OF THE INVENTION

It is an object of the present invention to overcome the disadvantages of the prior art and provide an oil extraction and gas production method capable of in-situ sand control and removal by downhole hydraulic lift, which avoids phenomenon of low production efficiency and decreased oil gas well production caused by the single sand control measures through the configuration of a downhole sieve tube and a soil-sand separator; which completes dual suction of downhole formation fluid through the hydraulic lift module and the formation fluid suction module, solving the suction and lift difficulty for formation fluid from high sand content oil well and high viscosity oil well; the utilization of downhole soli-sand separation module can achieve downhole preliminary separation of sand-contained petroleum or flammable ice, which reduces block and erosive wear on equipments and lengthens its service life while decreasing the energy consumption required during the wellbore lift process; the utilization of mixed fluid treatment module further processes the mixed fluid lifted to the ground, which completes the separation of oil, gas, sand, and water and effectively ensures the oil gas production or flammable ice production.

An oil extraction and gas production system capable of in-situ sand control and removal by downhole hydraulic lift is configured and it comprises a downhole oil extraction system and gas production and a ground oil extraction and gas production system;

the oil extraction and gas production system is composed of a downhole pipeline module, a hydraulic lift module, a downhole soil-sand separation module and a formation fluid suction module;

the downhole pipeline module is composed of a sleeve, a first double-layer tube comprising an outer tube A and an inner tube B, double-layer tube packer and a double-layer tube reducing joint connected to the first double-layer tube; the hydraulic lift module comprises a second double-layer tube connected to the double-layer tube reducing joint and comprising and outer tube C and an inner tube D, a third double-layer tube connected to the second double-layer tube through a first flow channel switching joint, a hydrodynamic turbine motor, a sludge screw pump and a drive shaft, wherein the second double-layer tube is connected to the double-layer tube packer, the third double-layer tube comprises an outer tube E and an inner tube F, the sludge screw pump and the hydrodynamic turbine motor are connected through the drive shaft and are respectively mounted within the inner tube D and the inner tube F and are connected, the drive shaft penetrates the first flow channel switching joint; the downhole soil-sand separation module comprises a fourth double-layer tube connected to the third double-layer tube through the second flow channel switching joint and comprising an outer tube G and an inner tube H and an soil-sand separator mounted within the inner tube H; the formation fluid suction module comprises a fifth double-layer tube connected to the fourth double-layer tube through the third flow channel switching joint, an oil tube connector, a negative pressure absorber, a sieve tube connected to the negative pressure absorber and a screw plug mounted above the sieve tube, the fifth segment bilateral tube comprises an outer tube I connected to the oil tube connector and an inner tube J connected to the inner channel of the negative pressure absorber;

the ground oil extraction and gas production system is composed of a power fluid pressurizing module, a mixed fluid processing module and a double-layer tube wellhead module;

the power fluid pressurizing module comprises a frequency conversion control cabinet, a power fluid pipeline string, a low pressure fluid filter sequentially mounted on the power fluid pipeline string, a high pressure plunger pump, a high pressure fluid filter, a hydraulic pressure sensor, a flow regulation valve and a power fluid flow sensor; the mixed fluid processing module is composed of a sand storage pool, a fluid storage pool, an oil supply line, an air supply line, a fluid discharge tube, a mixed fluid pipeline string, a mixed fluid flow sensor sequentially connected to the mixed fluid pipeline string, a sand-fluid separation device and an oil-gas-fluid separation device, the double-layer tube wellhead module comprises a power fluid injection port A, a power fluid injection port B, a mixed fluid outlet A, a mixed fluid outlet B, a fluid injection tube gate A, a fluid injection tube gate B, an oil tube gate A, an oil tube gate B and a wellhead gate; the power fluid injection port B is connected to the power fluid pipeline string in series and the mixed fluid outlet A is connected to a mixed fluid pipeline string;

based on the configuration of the oil extraction and gas production system capable of in-situ sand control and removal by downhole hydraulic lift, the oil extraction and gas production method comprises the following steps;

SI, power fluid pressurization and injection process, specifically comprising the following steps:

S101, the frequency conversion control cabinet controls the speed of the motor in the high pressure plunger pump to control the pressure of the power fluid pressurization;

S102, the high pressure plunger pump pressurizes the power fluid in the fluid storage pool to transfer the pressurized power fluid to the power fluid injection port B through the power fluid pipeline string;

S103, the pressurized power fluid enters the annular space formed between the outer tube A and the inner tube B of the first double-layer tube and enters the annular space formed between the outer tube C and the inner tube D of the second double-layer tube through the double-layer tube reducing joint;

S104, after passing through the first flow channel switching joint, the pressurized power fluid enters the inner tube F of the third double-layer tube through the annular space formed between the outer tube C and the inner tube D of the second double-layer tube, the hydrodynamic turbine motor begins to rotate under the push of the pressurized power fluid while driving the sludge screw pump connected thereto to rotate together through the drive shaft, thereby producing a suction force within the pump cavity of the sludge screw pump;

S105, after passing through the second flow channel switching joint, the pressurized power fluid flows from the inner tube F of the third double-layer tube into the annular space formed between the outer tube G and the inner tube Hof the fourth double-layer tube;

S106, after passing through the third flow channel switching joint, the pressurized power fluid enters from the annular space formed between the outer tube G and the inner tube H of the fourth double-layer tube into the inner tube J of the fifth double-layer tube and then enters the negative pressure absorber, thereby producing a negative pressure suction force;

S107, under the suction force of the sludge screw pump and the negative pressure absorber, the formation liquid enters the negative pressure absorber from the sieve tube and forms the mixed fluid after being mixed with the pressurized power fluid;

SII, the mixed fluid lift process, specifically comprising the following steps:

S201, the mixed fluid flows from the outer channel of the negative pressure absorber to the annular space formed between the outer tube I and the inner tube J of the fifth double-layer tube, and passes through the third flow channel switching joint to the inner tube H of the fourth double-layer tube;

S202, after the mixed fluid sequentially passes through two serial soil-sand separators, the sand particles are discharged from the sand discharge port of the soil-sand separator to the outside of the double-layer tube, and the desanded mixed fluid is discharged from the fluid discharge port of the soil-sand separator;

S203, after passing through the second flow channel switching joint, the separated mixed fluid enters from the inner tube H of the fourth double-layer tube into the annular space formed between the inner tube F and the outer tube E of the third double-layer tube;

S204, the mixed fluid within the annular space of third double-layer tube enters into the pump cavity of the sludge screw pump through the first flow channel switching joint, and is lifted through the mixed fluid outlet A of the sludge screw pump;

SIII, the mixed fluid ground treatment process, specifically comprising the steps:

S301, the mixed fluid enters the sand-fluid separation device through the mixed fluid pipeline string (and separates sand particles in the mixed fluid again;

S302, the separated sand particles are discharged from the sand release port of the sand-fluid separation device to the sand storage pool, the desanded mixed fluid enters the oil-gas-fluid separation device;

S303, the oil, gas and water obtained from the separation of the oil-gas-fluid separation device flow from the oil release port, the gas release port and the fluid release port to the oil transportation pipeline, the gas transportation pipeline and the fluid storage pool;

SIV, steps S101-S303 are repeated to complete the continuous oil extraction and gas production and cyclic utilization of power fluid.

Further, the double-layer tube wellhead module is connected to the sleeve and the first double-layer tube in the downhole pipeline module, wherein the outer tube A is interconnected with the power fluid injection port A and the power fluid injection port B, the inner tube B is interconnected with the mixed fluid outlet A and the mixed fluid outlet B.

Further, two sand-oil separators are provided in the downhole soil-sand separation module, wherein the sand discharge port of the soil-sand separator penetrates the inner tube H and the outer tube G.

Further, the first flow channel switching joint interconnects the inner tube D with the outer tube E while interconnecting the outer tube C with the inner tube F, the second channel changing joint interconnects the outer tube F with the outer tube G while interconnecting the outer tube E with the inner tube H, the third channel changing joint interconnects the inner tube H with the outer tube I while interconnecting the outer tube G and the inner tube J.

Further, the oil-gas-fluid separation device interconnects the fluid inlet with the fluid outlet of the sand-fluid separation devices through the mixed fluid pipeline string while interconnecting with the right end of the fluid storage pool through the fluid discharge tube; the power liquid pipeline string interconnects with the left end of the fluid storage pool, two sand control nets are configured between the left and right ends of the fluid storage pool.

The present invention has the following advantages:

(1) The self-configured soil-sand separation device saves the preliminary separation of filling materials, which reduces resistance that hinders the output of the formation fluid and increases the rate at which mixed fluid enters into the production wellbore;

(2) The utilization of the negative pressure absorber and the sludge screw pump greatly improves the suction effect of high viscosity oil, high sand content oil, high sand content natural gas and high sand content hydrates and increases the exploitation efficiency;

(3) As it is flexible contact between the stator and the rotor of the sludge screw pump and the suction force produced by the sludge screw pump is large, in addition to that the suction and discharge are uniform and stable, so pump block phenomenon will not occur, which ensures a stable suction and lift of formation fluid from downhole high viscosity oil and high sand content oil;

(4) The utilization of soil-sand separator to preliminarily separate the mixed fluid can decrease the sand content in the produced mixed fluid, effectively improve the purity of output products, alleviate the erosion and block of sand particles on downhole equipments and increase the overall service life of equipments;

(5) During the lift of mixed fluid, most sand particles are separated from the downhole to the outside of the double-layer tube, which improves the fluidity of mixed fluid during the process of lifting wellbore, greatly reduces the frictional resistance between the mixed fluid and each inner tube and effectively saves the energy consumption required during the lift;

(6) The in time backfilling of soil-sands separated in-situ can effectively control the content of flammable ice in the backfilled soil-sands so as to avoid an active breaking of the hydrate reservoir dynamic balance and ensure the stability of the well wall and the hydrate reservoir during the exploitation process.

Figure 1:
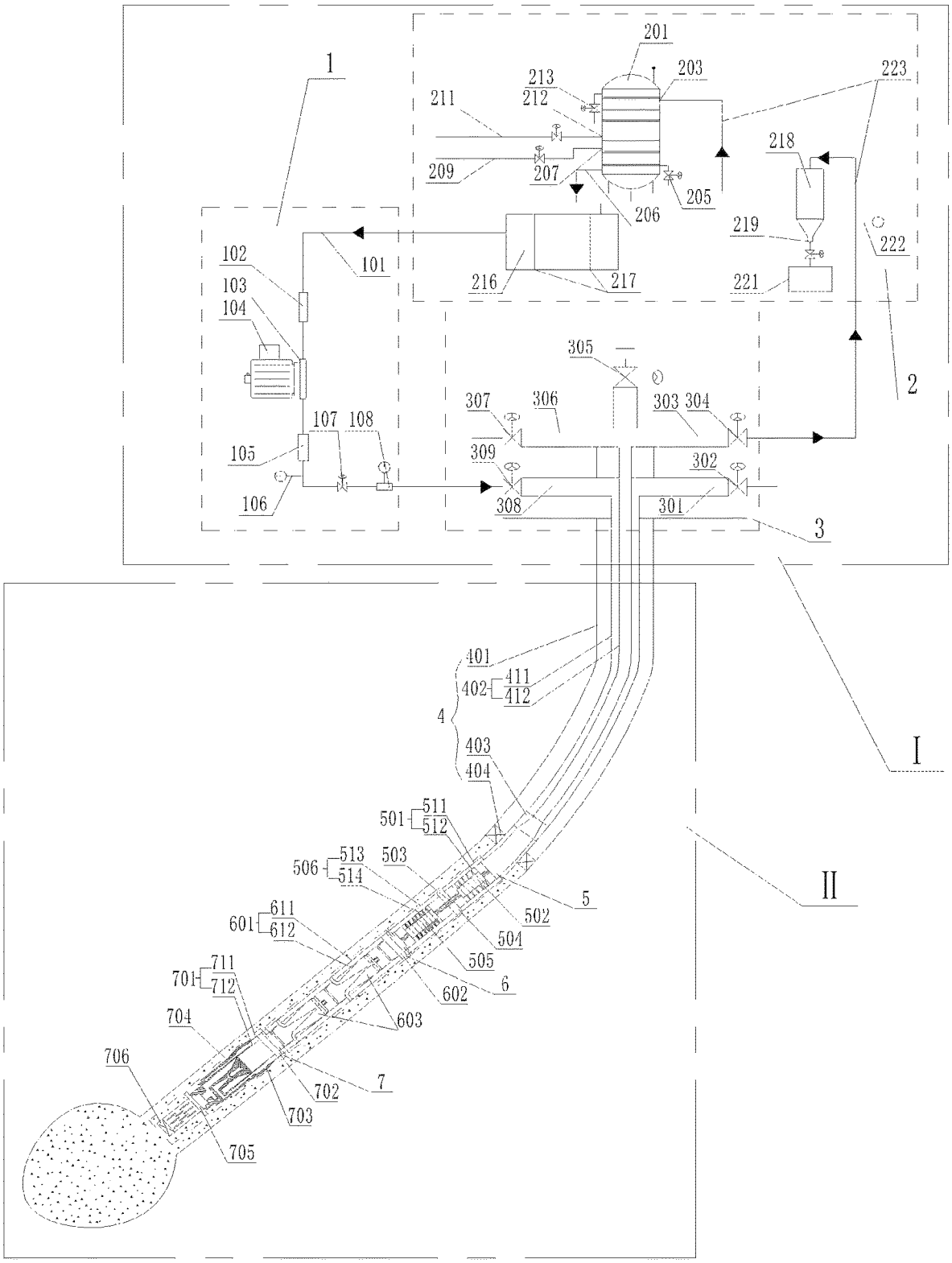
FIG. 1 is a schematic diagram of the oil extraction and gas production system without the injection of power fluid in the present invention.

in the drawings, I represents the ground oil extraction and gas production system, II represents the downhole oil extraction and gas production system, 1 represents the power fluid pressurization module, 101 represents the power fluid pipeline string, 102 represents the low pressure fluid filter, 103 represents the high pressure plunger pump, 104 represents the frequency conversion control cabinet, 105 represents the high pressure fluid filter, 106 represents the power fluid flow sensor, 107 represents the flow regulation valve, 108 represents the hydraulic pressure sensor; 2 represents the mixed fluid treatment module, 201 represents the oil-gas-fluid separation device, 203 represents the fluid inlet, 205 represents the blowdown valve, 206 represents the fluid discharge tube, 207 represents the oil release port, 208 represents the oil release valve, 209 represents the oil transportation pipeline, 211 represents the gas transportation pipeline, 212 represents the gas release port, 213 represents the overflow switch valve, 216 represents the fluid storage pool, 217 represents the filter screen, 218 represents the sand-fluid separation device, 219 represents the sand release port, 220 represents the sand discharge control valve, 221 represents the sand storage pool, 222 represents the mixed fluid flow sensor, 223 represents the mixed fluid pipeline string; 3 represents the double-layer tube wellhead module, 301 represents the power fluid injection port A, 302 represents the fluid injection tube gate A, 303 represents the mixed fluid outlet A, 304 represents the oil tube gate A, 305 represents the wellhead gate, 306 represents the mixed fluid outlet B, 307 represents the oil tube gate B, 308 represents the power fluid injection port B, 309 represents the fluid injection tube gate B; 4 represents the downhole pipeline module, 401 represents the sleeve, 402 represents the first double-layer tube, 403 represents the double-layer tube reducing joint, 404 represents the double-layer tube packer, 411 represents the outer tube A, 412 represents the inner tube B; 5 represents the hydraulic lift module, 501 represents the second double-layer tube, 502 represents the sludge screw pump, 503 represents the drive shaft, 504 represents the first flow channel switching joint, 5041 represents the first changing flow channel, 5042 represents the second changing flow channel, 5043 represents the thorough hole, 504A represents the top face of the first flow channel switching joint, 504B represents the bottom face of the first flow channel switching joint, 504C represents the side face of the first flow channel switching joint, 505 represents the hydrodynamic turbine motor, 506 represents the third double-layer tube, 511 represents the outer tube C, 512 represents the inner tube D, 513 represents the outer tube E, 514 represents the outer tube F; 6 represents the downhole soil-sand separation module, 601 represents the third double-layer tube, 602 represents the second flow channel switching joint, 603 represents the soil-sand separator, 611 represents the outer tube G, 612 represents the inner tube H; 7 represents the formation fluid suction module, 701 represents the fifth double-layer tube, 702 represents the third flow channel switching joint, 703 represents the oil tube connector, 704 represents the negative pressure absorber, 705 represents the sieve tube, 706 represents the screw plug, 711 represents the outer tube I, 712 represents the inner tube J.

DETAILED DESCRIPTION OF PREFERRED EMBODIMENTS

Now each embodiment in the present application is further described in combination with the drawings.

FIG. 1 shows the oil extraction and gas production system capable of in-situ sand control and removal by downhole hydraulic lift and it comprises a downhole oil extraction and gas production system and a ground oil extraction and gas production system;

the oil extraction and gas production system is composed of a downhole pipeline module 4, a hydraulic lift module 5, a downhole soil-sand separation module 6 and a formation fluid suction module 7;

the downhole pipeline module 4 is composed of a sleeve 401, a first double-layer tube 402 comprising an outer tube A 411 and an inner tube B 412, a double-layer tube packer 404 and a double-layer tube reducing joint 403 connected to the first double-layer tube 402; the hydraulic lift module 5 comprises a second double-layer tube 501 connected to the double-layer tube reducing joint 403 and comprising and outer tube C 511 and an inner tube D 512, a third double-layer tube 506 connected to the second double-layer tube 501 through a first flow channel switching joint 504, a hydrodynamic turbine motor 505, a sludge screw pump 502 and a drive shaft 503, wherein the second double-layer tube 501 is connected to the double-layer tube packer 404, the third double-layer tube 506 comprises an outer tube E 513 and an inner tube F 514, the sludge screw pump 502 and the hydrodynamic turbine motor 505 are connected through the drive shaft 503 and are respectively mounted within the inner tube D 512 and the inner tube F 514, the drive shaft 503 penetrates the first flow channel switching joint 504; the downhole soil-sand separation module 6 comprises a fourth double-layer tube 601 connected to the third double-layer tube 506 through the second flow channel switching joint 602 and comprising an outer tube G 611 and an inner tube H 612 and an soil-sand separator 603 mounted within the inner tube H 612; the formation fluid suction module 7 comprises a fifth double-layer tube 701 connected to the fourth double-layer tube 601 through the third flow channel switching joint 702, an oil tube connector 703, a negative pressure absorber 704, a sieve tube 705 connected to the negative pressure absorber 704 and a screw plug 706 mounted on the sieve tube 705, the fifth segment bilateral tube 701 comprises an outer tube I 711 connected to the oil tube connector 703 and an inner tube J 712 connected to the inner channel of the negative pressure absorber 704.

It should be noted that the sludge screw pump 502 is preferably a downhole screw pump. The inner charity of the stator on the sludge screw pump 502 is poured with a rubber lining structure. Of course, the rubber lining can also be replaced by other flexible materials. Such configuration of flexible contact between the stator and the rotor can achieve a large suction force on the sludge screw pump as well a uniform and stable suction and discharge, which avoids the phenomenon of pump being stuck and ensures a stable suction and lift of formation fluid under high viscosity oil and high sand content oil in the downhole.

It should be noted that the negative pressure absorber 704 described above is preferably a jet pump.

The configuration of the negative pressure absorber 704 and the sludge screw pump 502 achieves double suction of the mixed fluid by both the negative pressure absorber 704 and the sludge screw pump 502, which greatly improves the suction effect of high viscosity oil, high sand content oil and high sand content natural gas hydrates and increases the exploitation efficiency.

It should be noted that the soil-sand separator 603 is preferably a cyclone separator. The configuration of the sieve tube 705 and the screw plug 706 mounted on the head of the sieve tube 705 and the configuration of soil-sand separator 603 can achieve the preliminary separation of soil-sands in the mixed fluid and decrease the sand content of the produced mixed fluid, which effectively improves the purity of the output products, reduces the erosion and blockage resulted from sand particles on downhole equipments and improves the overall service life of equipments. At the same time, it is possible to improve the fluidity of the mixed fluid during the process of lifting wellbore, reduce the resistance that hinders the production of formation fluid, increase the rate at which the mixed fluid enters the production wellbore, improve the production efficiency and reduce the energy consumption of lift during the production process. Further, the configuration of soil-sand separator 603 can achieve the preliminary separation of soil-sand in the mixed fluid as well as effects that soil-sands separated from the soil-sand separator 603 can be backfilled in time and thus the content of flammable ice in the backfilled soil-sands can be effectively controlled so as to avoid an active breaking of the hydrate reservoir dynamic balance and ensure the stability of the well wall and the hydrate reservoir during the exploitation process. Further, the double-layer tube reducing joint 403 connects the first double-layer tube 402 and the second double-layer tube 501 in a threaded connection manner. The first flow channel switching joint 504, the second flow channel switching joint 602 and the third flow channel switching joint 702 connects the second double-layer tube 501 with the third double-layer tube 506, the third double-layer tube 506 with the fourth double-layer tube 601 as well as the fourth double-layer tube 601 with the fifth double-layer tube 701 in a threaded connection manner. It should be noted that the second flow channel switching joint 602 and the third flow channel switching joint 702 are structurally consistent. The difference between the first flow channel switching joint 502 and the second flow channel switching joint 602 and the third flow channel switching joint 702 lies in that a through hole 5043 through which the drive shaft 503 passes is provided on the first flow channel switching joint 504. Taking the first flow channel switching joint 504 whose inside is configured with the first changing flow channel 5041 and the second changing flow channel 5042 as an example, the power fluid flows through the first changing flow channel 5041 and the mixed fluid flows through the second changing flow channel 5042. In the drawings, 504A represents the top face of the first flow channel switching joint 504, 504B represents the bottom face of the first flow channel switching joint 504 and 504C represents the side face of the first flow channel switching joint 504.

Further, the first flow channel switching joint 504 interconnects the inner tube D512 with the outer tube E513 while interconnecting the outer tube C511 with the inner tube F514. The second flow channel switching joint 602 interconnects the inner tube F514 and the outer tube G611 while interconnecting the outer tube E513 with the inner tube H612. The third flow channel switching joint 702 interconnects the inner tube H612 with the outer tube I711 while interconnecting the outer tube G611 with the inner tube J712.

Further, the oil tube connector 703 connects the negative pressure absorber 704 with the outer tube I711 in a threaded connection manner, wherein the outer channel of the negative pressure absorber 704 is interconnected with the annular space of the fifth double-layer tube 701 and the inner channel of the negative pressure absorber 704 is interconnected with the inner tube J712.

Further, the sieve tube 705 is connected with the negative pressure absorber 704 in a threaded connection or welding manner. The screw plug 706 is connected with the sieve tube 705 in a threaded connection, welding connection or other connection manners, wherein the sieve tube 705 is used to filter out the sand particles with a too large diameter in the formation fluid, the screw plug 706 is used to block the bottom of the sieve tube 705 so that the formation fluid can only be allowed to enter the circumferential slits via the sieve tube 705.

Further, the double-layer tube packer 404 can also be mounted on any outer tubes between the sand discharge port of the soil-sand separator 603 and the double-layer tube reducing joint 403 according to the actual condition needs; at least one soil-sand separator 603 is provided in the downhole soil-sand separation module 6, wherein the sand discharge port of the soil-sand separator 603 penetrates the inner tube H612 and the outer tube G611. The oil extraction and gas production system consists of the power fluid pressurization module 1, the mixed fluid treatment module 2 and the double-layer tube wellhead module 3.

Specifically, the power fluid pressurization module 1 comprises a frequency conversion control cabinet 104, a power fluid pipeline string 101 and a low pressure fluid filter 102 & a high pressure plunger pump 103 & a high pressure fluid filter 105 & a power fluid flow sensor 106 & a flow regulation valve 107 & a hydraulic pressure sensor 108 sequentially mounted on the power fluid pipeline string 101; the mixed fluid treatment module 2 consists of a sand storage pool 221, a fluid storage pool 216, a oil transportation pipeline 209, a gas transportation pipeline 211, a fluid discharge tube 206, a mixed fluid pipeline string 223 and a mixed fluid flow sensor 222 & a sand-fluid separation device 218 & a oil-gas-fluid separation device 201 sequentially connected to the mixed fluid pipeline string 223; the double-layer tube wellhead module 3 comprises a power fluid injection port A 301, a power fluid injection port B 308, a mixed fluid outlet A 303, a mixed fluid outlet B 306, a fluid injection tube gate A 302, a fluid injection tube gate B 309, an oil tube gate A 304, an oil tube gate B 307 and a wellhead gate 305; the power fluid injection port B 308 is connected to the power fluid pipeline string 101 and the mixed fluid outlet A 303 is connected to the mixed fluid pipeline string 223.

The sleeve 401 can be connected to the double-layer tube wellhead module 3 in a threaded connection, a flange connection, a welding connection or other connection manners. The inner tube B 412 is connected to the double-layer tube wellhead module 3 in a threaded connection, welding connection or other connection manners and is interconnected with the mixed fluid outlet A 303, the mixed fluid outlet B 306 and the wellhead gate 305. The outer tube A 411 can be connected to the double-layer tube wellhead module 3 in a threaded connection, a welding connection or other connection manners and is interconnected with the power fluid injection port A 301 and the power fluid injection port B 308.

Further, if the power fluid pipeline string 101 is interconnected both with the power fluid injection port A 301 and the power fluid injection port B 308 and the mixed fluid pipeline string 223 is also interconnected both with the mixed fluid outlet A 303 and the mixed fluid outlet B 306, then the flow rate and hydraulic pressure of the power fluid in the downhole oil extraction and gas production system can be increased significantly, thereby improving the lifting capacity of the mixed fluid and increasing the oil gas production efficiency.

The oil-gas-fluid separation device 201 interconnects the mixed fluid inlet 203 with the outlet of the sand-fluid separation device 218 through the mixed fluid pipeline string 223 and is also interconnected with the right end of the fluid storage pool 216 through the fluid discharge tube 206; the power fluid pipeline string 101 is interconnected with the left end of the fluid storage pool 216 and at least one sand control net 217 is provided between the left and right ends of the fluid storage pool 216, wherein the sand control net 217 is used to filter the power fluid in the fluid storage pool 216 to reduce impurities in the power fluid flowed into the high pressure plunger pump 103 and lower the erosion and loss of the high pressure plunger pump 103. A liquid level line or a liquid level sensor is also provided in the fluid storage pool 216 and the power fluid is injected in advance into the fluid storage pool 216. Given that a certain loss of power fluid will occur during the oil extraction and gas production cycle, it is necessary to add power fluid from the outside to allow the liquid the fluid level of the storage pool 216 be provided between the determined highest liquid level and lowest liquid level when the power fluid in the fluid storage pool 216 shows a liquid level lower than the determined lowest liquid level.

Figure 2:
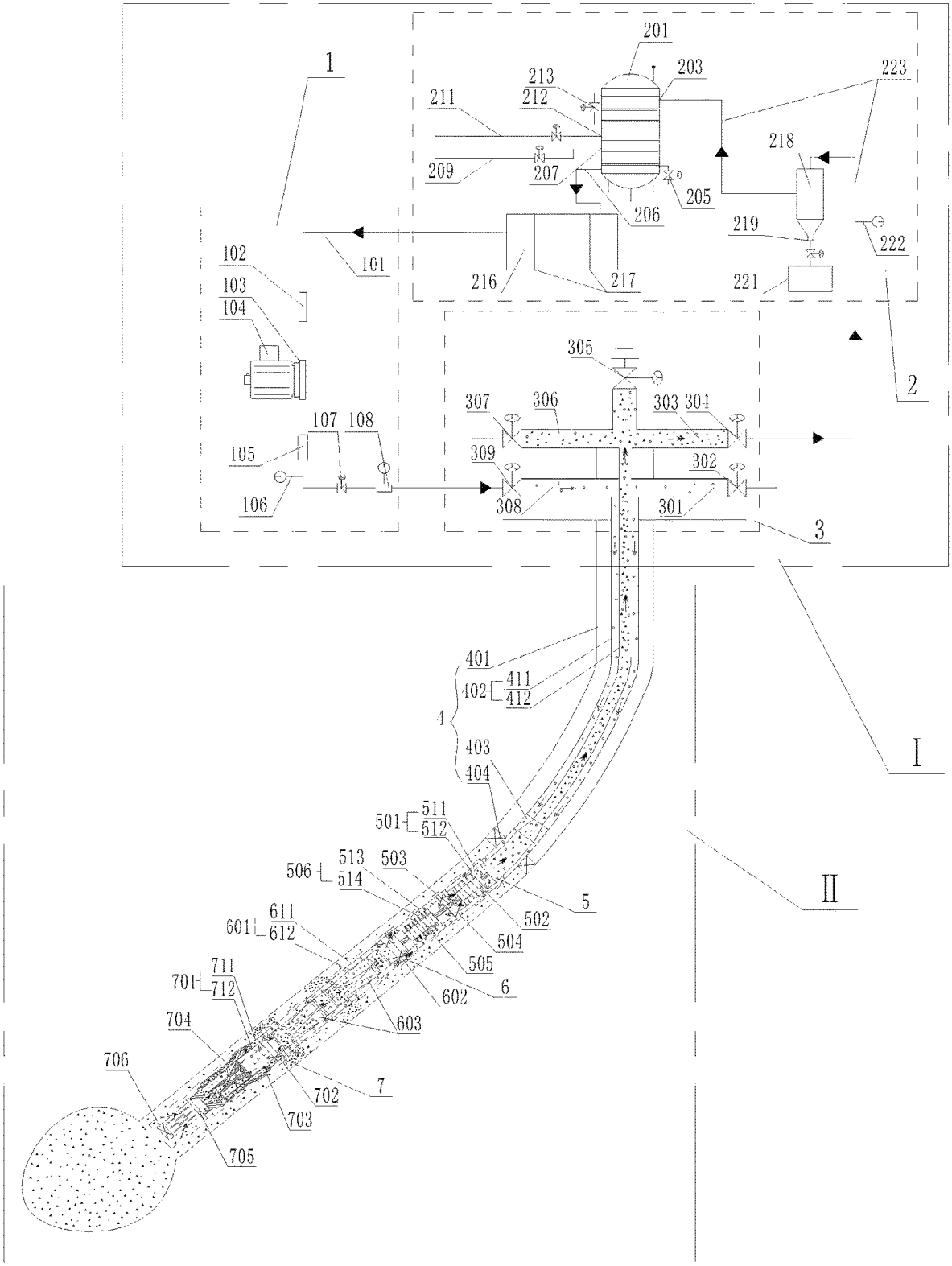
FIG. 2 is a schematic diagram of the oil extraction and gas production system with the injection of power fluid in the present invention.
Figure 3:
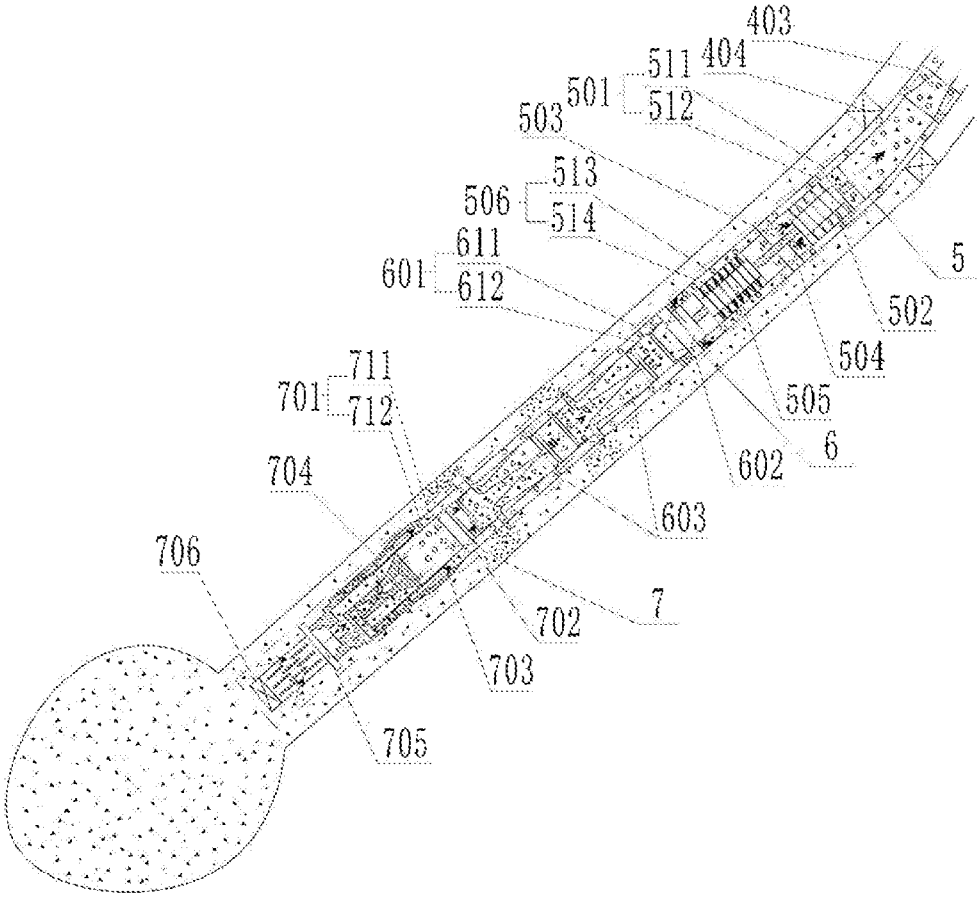
FIG. 3 is a partially enlarged view of part II in FIG. 2.
Figure 4:
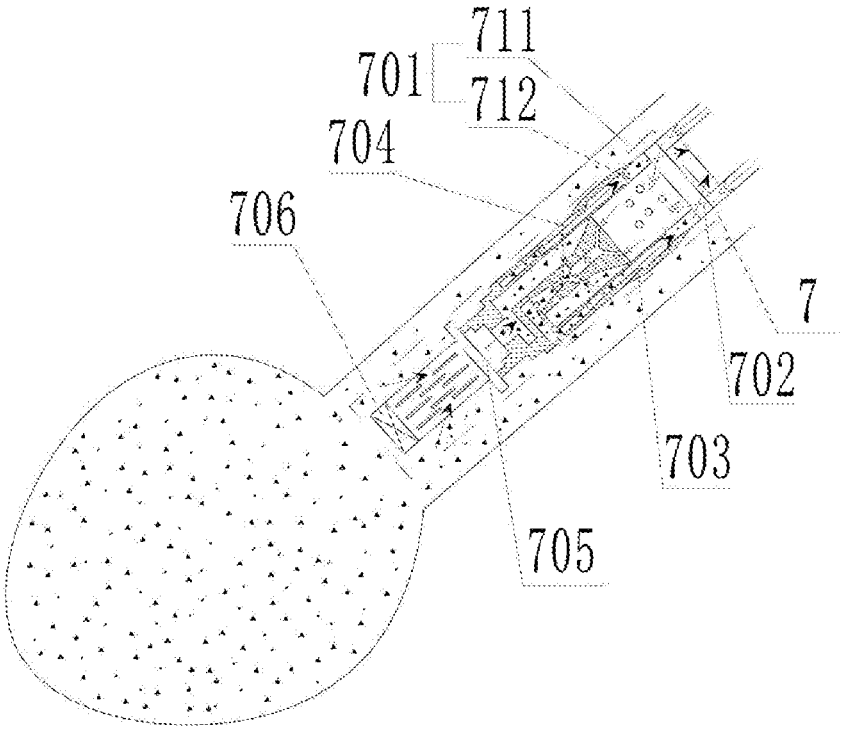
FIG. 4 is an enlarged view of the formation fluid suction module in FIG. 3.
Figure 5:
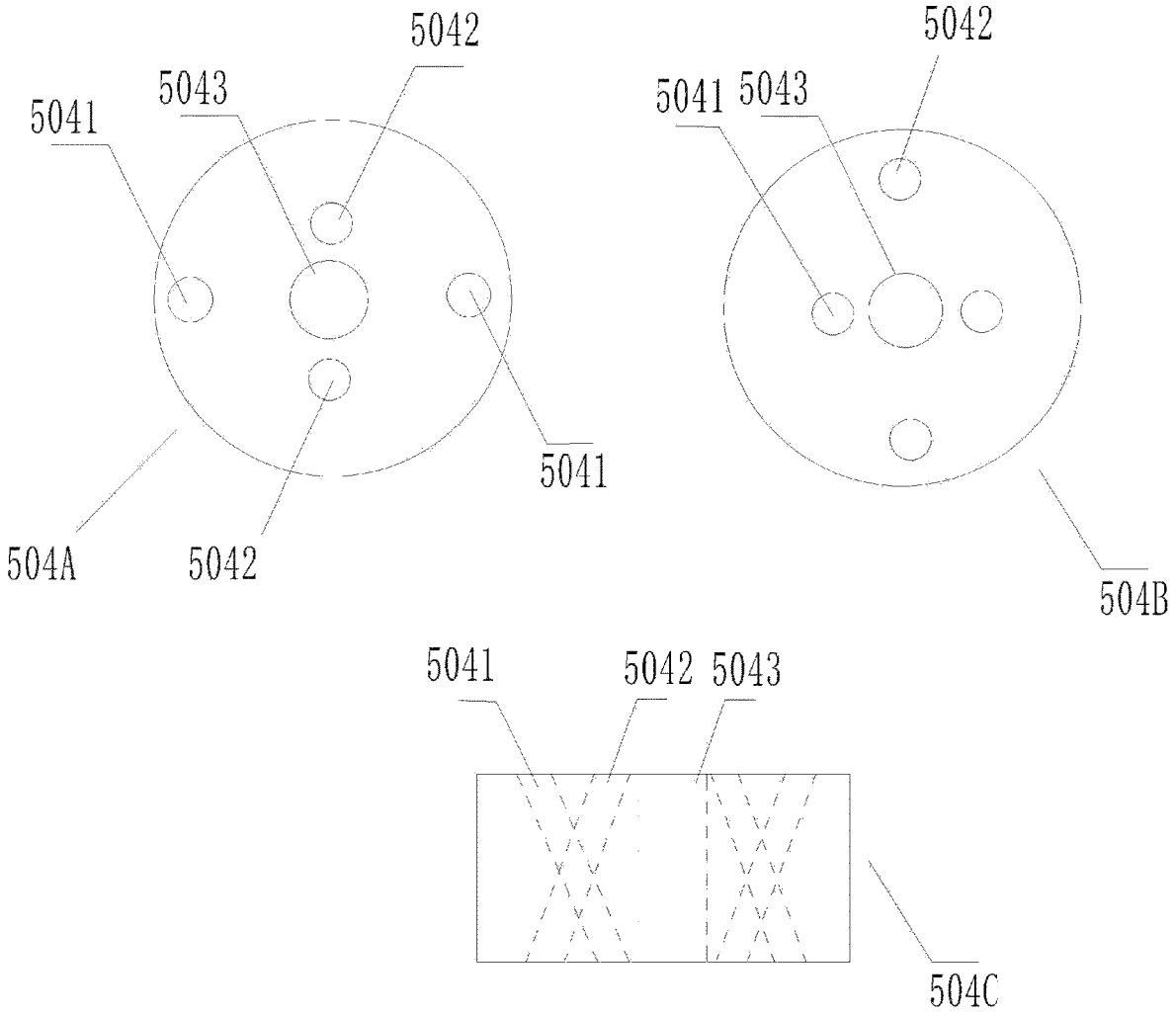
FIG. 5 is a schematic structural diagram of the first flow channel switching joint in FIG. 3.
Figure 6:
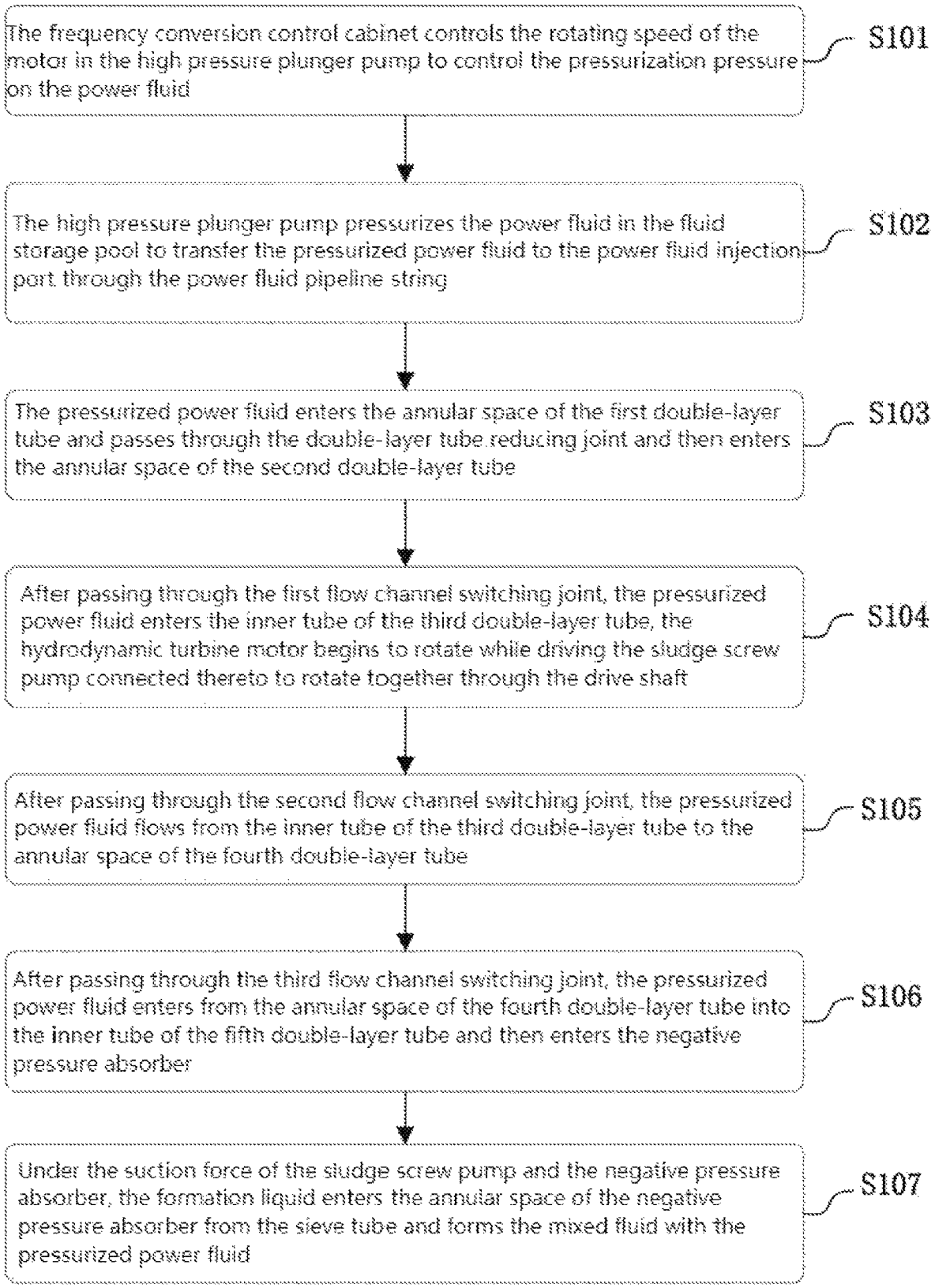
FIG. 6 is a process diagram of injecting the pressurized power fluid in the present invention.
Figure 7:
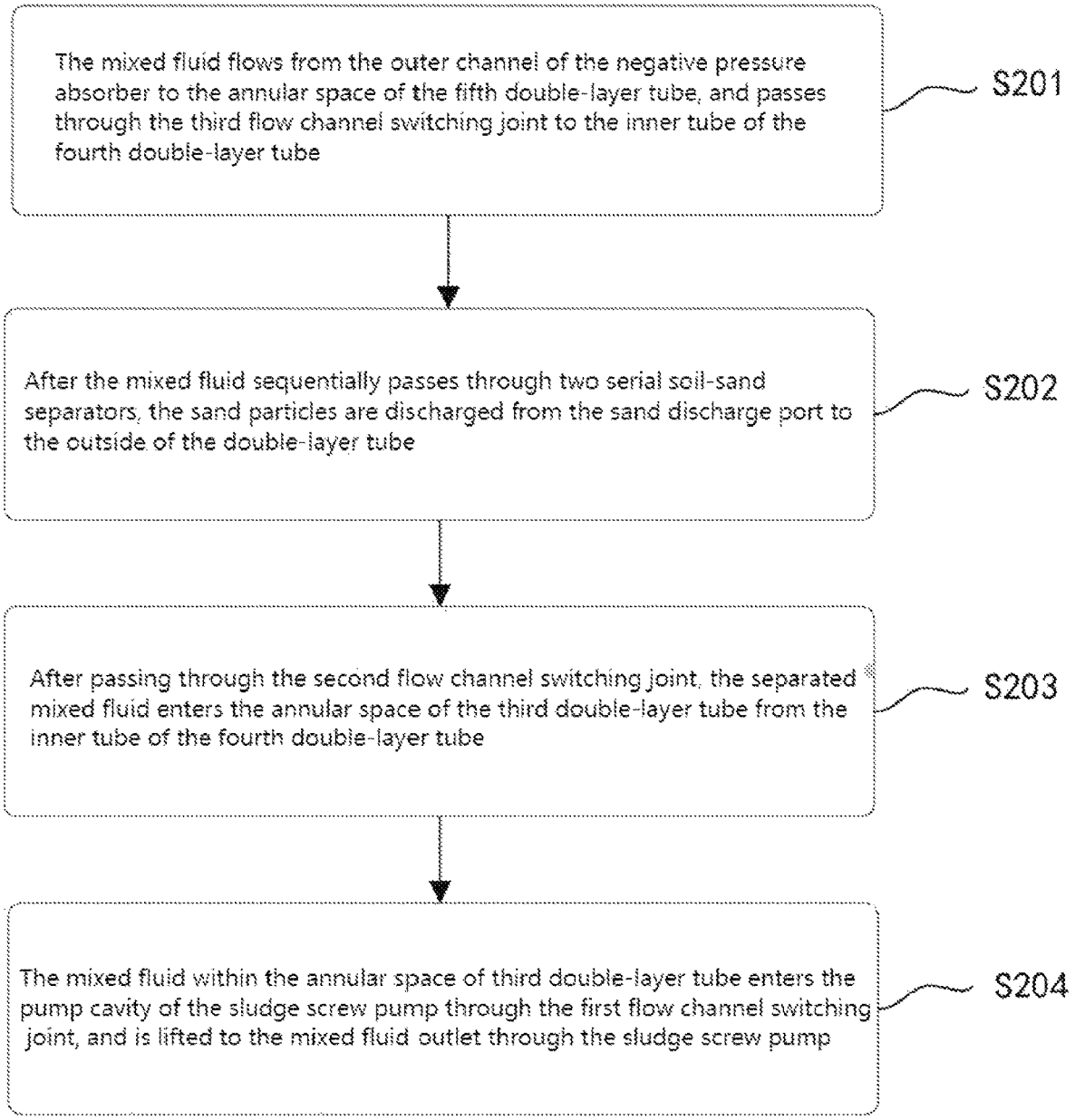
FIG. 7 is a process diagram of lifting the mixed fluid in the present invention.
Figure 8:
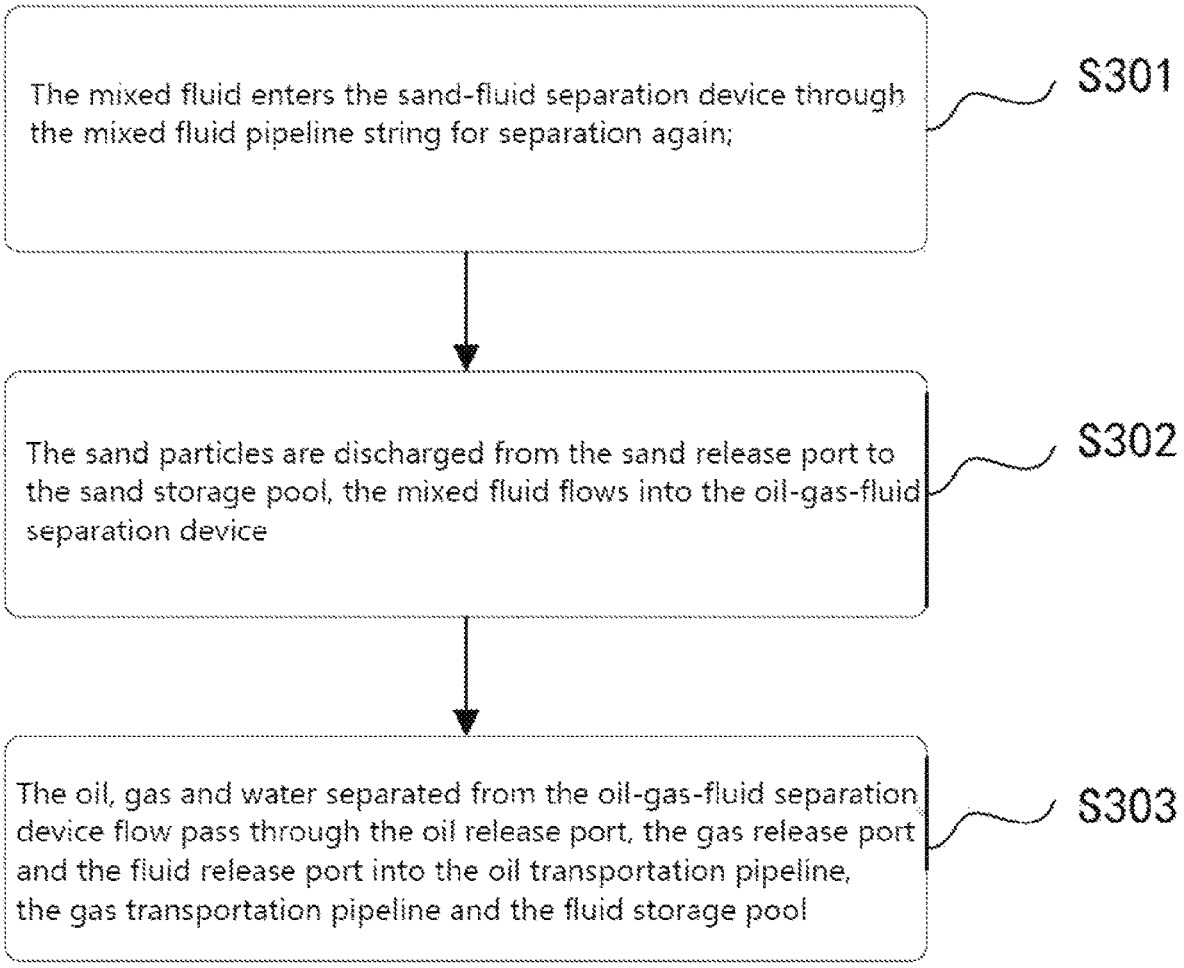
FIG. 8 is a process diagram of the ground treatment for mixed fluid in the present invention.

On the basis of the oil extraction and gas production method capable of in-situ sand control and removal by downhole hydraulic lift, the oil extraction and gas production method in the present disclosure comprises the following steps:

SI, power fluid pressurization and injection process, specifically comprising the following steps:

S101, when the pressure of the hydraulic pressure sensor 108 in the power fluid pipeline string 101 is bigger than the determined pressure threshold, the frequency conversion control cabinet 104 controls the rotation speed of the motor in the high pressure plunger pump 103 to decrease, the pressure of the pressurized power fluid and the mixed fluid is reduced;

S102, the high pressure plunger pump 103 pressurizes the power fluid in the fluid storage pool 216 to transfer the pressurized power fluid to the power fluid injection port A 301 and the power fluid injection port B 308 through the power fluid pipeline string 101, wherein the pressurized power fluid sequentially passes through the low pressure fluid filter 102, the high pressure plunger pump 103, the high pressure fluid filter 105, the power fluid flow sensor 106, the flow regulation valve 107 and the hydraulic pressure sensor 108;

S103, the pressurized power fluid enters the annular space formed between the outer tube A 411 and the inner tube B 412 of the first double-layer tube 402 and enters the annular space formed between the outer tube C 511 and the inner tube D 512 of the second double-layer tube 501 through the double-layer tube reducing joint 403;

S104, after passing through the first flow channel switching joint 504, the pressurized power fluid enters the inner tube F 514 of the third double-layer tube 506 through the annular space formed between the outer tube C 511 and the inner tube D 512 of the second double-layer tube 501, the hydrodynamic turbine motor 505 begins to rotate under the push of the pressurized power fluid while driving the sludge screw pump 502 connected thereto to rotate together through the drive shaft 503, thereby producing a suction force within the pump cavity of the sludge screw pump 502;

S105, after passing through the second flow channel switching joint 602, the pressurized power fluid flows from the inner tube F 514 of the third double-layer tube 506 to the annular space formed between the outer tube G 611 and the inner tube H 612 of the fourth double-layer tube 601;

S106, after passing through the third flow channel switching joint 702, the pressurized power fluid enters from the annular space formed between the outer tube G 611 and the inner tube H 612 of the fourth double-layer tube 601 into the inner tube J 712 of the fifth double-layer tube 701 and then enters the inner channel of the negative pressure absorber 704, thereby producing a negative pressure suction force;

S107, under the suction force of the sludge screw pump 502 and the negative pressure absorber 704, the formation liquid enters the inner annulus of the negative pressure absorber 704 from the sieve tube 705 and forms the mixed fluid after being mixed with the pressurized power fluid;

wherein the downhole flow direction of the pressurized power fluid is in consistence with the flow direction of the hollow arrow in FIG. 2-FIG. 4.

SII, the mixed fluid lift process, specifically comprising the following steps:

S201, the mixed fluid flows from the outer channel of the negative pressure absorber 704 to the annular space formed between the outer tube I 711 and the inner tube J 712 of the fifth double-layer tube 701, and passes through the third flow channel switching joint 702 to the inner tube H 612 of the fourth double-layer tube 601;

S202, after the mixed fluid sequentially passes through two serial soil-sand separators 603, the sand particles are discharged from the sand discharge port of the soil-sand separator 603 to the outside of the double-layer tube, and the desanded mixed fluid is discharged from the fluid discharge port of the soil-sand separator 603;

S203, after passing through the second flow channel switching joint 602, the separated mixed fluid enters from the inner tube H 612 of the fourth double-layer tube 601 into the annular space formed between the inner tube F 514 and the outer tube E 513 of the third double-layer tube 506;

S204, the mixed fluid within the annular space of third double-layer tube 506 enters into the pump cavity of the sludge screw pump 502 from the first flow channel switching joint 504, and is lifted through the mixed fluid outlet A 303 of the sludge screw pump 502;

wherein the flow direction of mixed fluid separated from downhole soil-sand separation is in consistence with the flow direction of the double solid arrows in FIG. 2-FIG. 4 and the flow direction of mixed fluid not separated from downhole soil-sand separation is in consistence with the flow direction of the single solid arrows in FIG. 2-FIG. 4.

SIII, the mixed fluid ground treatment process, specifically comprising the steps:

S301, the mixed fluid enters the sand-fluid separation device 218 through the mixed fluid pipeline string 223 and separates sand particles in the mixed fluid again;

S302, the separated sand particles are discharged from the sand release port 219 of the sand-fluid separation device 218 to the sand storage pool 221, the desanded mixed fluid enters the oil-gas-fluid separation device 201, the frequency conversion control cabinet 104 controls the motor of the high pressure plunger pump 103 to lower the rotation speed and decrease the fluid feed volume of the oil-gas-fluid separation device while opening the overflow switch valve 213 to ensure the safe operation of the oil-gas-fluid separation device 201, given that small amount of sand particles will still enter into the oil-gas-fluid separation device 201 after the mixed fluid is separated by the sand-fluid separation device 218, the blowdown valve 205 can be open periodically to proceed the blowdown treatment;

S303, the oil, fluid and gas obtained from the separation of the oil-gas-water separation device 201 flow from the oil release port 207, the gas release port 212 and the fluid release port 206 to the oil transportation pipeline 209, the gas transportation pipeline 211 and the fluid storage pool 216.

SIV, steps S101-S303 are repeated to complete the continuous oil extraction and gas production and cyclic utilization of power fluid.

What is claimed is:

1. An oil extraction and gas production method capable of in-situ sand control and removal by downhole hydraulic lift, wherein an oil extraction and gas production system capable of in-situ sand control and removal by downhole hydraulic lift is configured to comprise a downhole oil extraction and gas production system and a ground oil extraction and gas production system;

the downhole oil extraction and gas production system is composed of a downhole pipeline module (4), a hydraulic lift module (5), a downhole soil-sand separation module (6) and a formation fluid suction module (7);

the downhole pipeline module (4) is composed of a sleeve (401), a first double-layer tube (402) comprising an outer tube A (411) and an inner tube B (412), a double-layer tube reducing joint (403) connected to the first double-layer tube (402) and a double-layer tube packer (404); the hydraulic lift module (5) comprises a second double-layer tube (501) connected to the double-layer tube reducing joint (403) and comprising an outer tube C (511) and an inner tube D (512), a third double-layer tube (506) connected to the second double-layer tube (501) through a first flow channel switching joint (504), a hydrodynamic turbine motor (505), a sludge screw pump (502) and a drive shaft (503), wherein the second double-layer tube (501) is connected to the double-layer tube packer (404), the third double-layer tube (506) comprises an outer tube E (513) and an inner tube F (514), the sludge screw pump (502) and the hydrodynamic turbine motor (505) are respectively mounted within the inner tube D (512) and the inner tube F (514) and are connected through the drive shaft (503), the drive shaft (503) penetrates the first flow channel switching joint (504); the downhole soil-sand separation module (6) comprises a second flow channel switching joint (602), a fourth double-layer tube (601) connected to the third double-layer tube (506) through the second flow channel switching joint (602) and comprising an outer tube G (611) and an inner tube H (612) and an soil-sand separator (603) mounted within the inner tube H (612); the formation fluid suction module (7) comprises a third flow channel switching joint (702), a fifth double-layer tube (701) connected to the fourth double-layer tube (601) through the third flow channel switching joint (702), an oil tube connector (703), a negative pressure absorber (704), a sieve tube (705) connected to the negative pressure absorber (704) and a screw plug (706) mounted above the sieve tube (705), the fifth double-layer tube (701) comprises an outer tube I (711) connected to the oil tube connector (703) and an inner tube J (712) connected to the inner channel of the negative pressure absorber (704);

the ground oil extraction and gas production system is composed of a power fluid pressurizing module (1), a mixed fluid processing module (2) and a double-layer tube wellhead module (3);

the power fluid pressurizing module (1) comprises a frequency conversion control cabinet (104), a power fluid pipeline string (101), and a low pressure fluid filter (102), a high pressure plunger pump (103), a high pressure fluid filter (105), a power fluid flow sensor (106), a flow regulation valve (107) and a hydraulic pressure sensor (108) sequentially mounted on the power fluid pipeline string (101); the mixed fluid processing module (2) is composed of a sand storage pool (221), a fluid storage pool (216), an oil transportation pipeline (209), a gas transportation pipeline (211), a fluid discharge tube (206), a mixed fluid pipeline string (223), a mixed fluid flow sensor (222) sequentially connected to the mixed fluid pipeline string (223), a sand-fluid separation device (218) and an oil-gas-fluid separation device (201), the double-layer tube wellhead module (3) comprises a power fluid injection port A (301), a power fluid injection port B (308), a mixed fluid outlet A (303), a mixed fluid outlet B (306), a fluid injection tube gate A (302), a fluid injection tube gate B (309), an oil tube gate A (304), an oil tube gate B (307) and a wellhead gate (305); the power fluid injection port B (308) is connected to the power fluid pipeline string (101) and the mixed fluid outlet A (303) is connected to the mixed fluid pipeline string (223);

the oil extraction and gas production method comprises the following steps:

SI, power fluid pressurization and injection process, specifically comprising the following steps:

S101, the frequency conversion control cabinet (104) controls a rotating speed of a motor in the high pressure plunger pump (103) to control a pressure of the power fluid pressurization;

S102, the high pressure plunger pump (103) pressurizes power fluid in the fluid storage pool (216) to transfer the pressurized power fluid to the power fluid injection port B (308) through the power fluid pipeline string (101);

S103, the pressurized power fluid enters an annular space formed between the outer tube A (411) and the inner tube B (412) of the first double-layer tube (402) and enters an annular space formed between the outer tube C (511) and the inner tube D (512) of the second double-layer tube (501) through the double-layer tube reducing joint (403);

S104, after passing through the first flow channel switching joint (504), the pressurized power fluid enters the inner tube F (514) of the third double-layer tube (506) through the annular space formed between the outer tube C (511) and the inner tube D (512) of the second double-layer tube (501), the hydrodynamic turbine motor (505) begins to rotate under a push of the pressurized power fluid while driving the sludge screw pump (502) connected thereto to rotate together through the drive shaft (503), thereby producing a suction force within pump cavity of the sludge screw pump (502);

S105, after passing through the second flow channel switching joint (602), the pressurized power fluid flows from the inner tube F (514) of the third double-layer tube (506) into an annular space formed between the outer tube G (611) and the inner tube H (612) of the fourth double-layer tube (601);

S106, after passing through the third flow channel switching joint (702), the pressurized power fluid enters from the annular space formed between the outer tube G (611) and the inner tube H (612) of the fourth double-layer tube (601) into the inner tube J (712) of the fifth double-layer tube (701) and then enters the negative pressure absorber (704), thereby producing a negative pressure suction force;

S107, under the suction force of the sludge screw pump (502) and the negative pressure suction force of absorber (704), a formation liquid enters the negative pressure absorber (704) from the sieve tube (705) and forms a mixed fluid after being mixed with the pressurized power fluid;

SII, a mixed fluid lift process, specifically comprising the following steps:

S201, the mixed fluid flows from an outer channel of the negative pressure absorber (704) to an annular space formed between the outer tube I (711) and the inner tube J (712) of the fifth double-layer tube (701), and passes through the third flow channel switching joint (702) to the inner tube H (612) of the fourth double-layer tube (601);

S202, after the mixed fluid sequentially passes through two soil-sand separators (603) in series connection, sand particles are discharged from a sand discharge port of the soil-sand separator (603) to an outside of the fourth double-layer tube, and the desanded mixed fluid is discharged from a fluid discharge port of the soil-sand separator (603);

S203, after passing through the second flow channel switching joint (602), the separated mixed fluid enters from the inner tube H (612) of the fourth double-layer tube (601) into an annular space formed between the inner tube F (514) and the outer tube E (513) of the third double-layer tube (506);

S204, the mixed fluid within the annular space of third double-layer tube (506) enters the pump cavity of the sludge screw pump (502) through the first flow channel switching joint (504), and is lifted to the mixed fluid outlet A (303) by the sludge screw pump (502);

SIII, a mixed fluid ground treatment process, specifically comprising the steps:

S301, the mixed fluid enters the sand-fluid separation device (218) through the mixed fluid pipeline string (223) and separates sand particles in the mixed fluid again;

S302, the separated sand particles are discharged from the sand release port (219) of the sand-fluid separation device (218) to the sand storage pool (221), the desanded mixed fluid enters the oil-gas-fluid separation device (201);

S303, oil, water and gas obtained from a separation of the oil-gas-fluid separation device (201) flow from an oil release port (207), a gas release port (212) and the fluid discharge tube (206) to the oil transportation pipeline (209), the gas transportation pipeline (211) and the fluid storage pool (216);

SIV, steps S101-S303 are repeated to complete a continuous oil extraction and gas production and cyclic utilization of power fluid.

2. The oil extraction and gas production method of claim 1, wherein the lower end of the double-layer tube wellhead module (3) is connected to the sleeve (401) and the first double-layer tube (402) in the downhole pipeline module (4), wherein the outer tube A (411) is interconnected with the power fluid injection port A (301) and the power fluid injection port B (308), the inner tube B (412) is interconnected with the mixed fluid outlet A (303) and the mixed fluid outlet B (306).

3. The oil extraction and gas production method of claim 1, wherein two sand-oil separators (603) are provided in the downhole soil-sand separation module (6), wherein the sand discharge port of the soil-sand separator (603) penetrates the inner tube H (612) and the outer tube G (611).

4. The oil extraction and gas production method of claim 1, wherein the first flow channel switching joint (504) interconnects the inner tube D (512) with the outer tube E (513) while interconnecting the outer tube C (511) with the inner tube F (514), the second channel changing joint (602) interconnects the outer tube F (514) with the outer tube G (611) while interconnecting the outer tube E (513) with the inner tube H (612), the third channel changing joint (702) interconnects the inner tube H (612) with the outer tube I (711) while interconnecting the outer tube G (611) and the inner tube J (712).

5. The oil extraction and gas production method of claim 1, wherein the oil-gas-fluid separation device (201) interconnects the fluid inlet (203) with a fluid outlet of the sand-fluid separation device (218) through the mixed fluid pipeline string (223) while further interconnecting with a right end of the fluid storage pool (216) through the fluid discharge tube (206); the power fluid pipeline string (101) is interconnected with a left end of the fluid storage pool (216), two sand control nets are configured between the left end and the right end of the fluid storage pool (216).

* * * * *